United States Patent [19]

Cooper et al.

[11] 4,262,444

[45] Apr. 21, 1981

[54] BIG MOUTH DOLL

[75] Inventors: Julius Cooper, New Hyde Park; Burt W. Ensmann, Flushing, both of N.Y.

[73] Assignee: Ideal Toy Corporation, Hollis, N.Y.

[21] Appl. No.: 43,869

[22] Filed: May 29, 1979

[51] Int. Cl.[3] ..... A63H 11/00

[52] U.S. Cl. ..... 46/119; 46/141

[58] Field of Search ..... 46/118, 119, 135 R, 46/141, 123, 124, 164, 171

[56] References Cited

U.S. PATENT DOCUMENTS

| | | | |
|---|---|---|---|
| 1,859,268 | 5/1932 | Larson | 46/118 |
| 2,455,266 | 11/1948 | Nudelman | 46/141 |
| 2,572,795 | 10/1951 | Wood et al. | 46/141 |
| 3,032,921 | 5/1962 | Greene | 46/118 |
| 3,119,198 | 1/1964 | Ogata | 46/118 |
| 3,186,126 | 6/1965 | Ostrander | 46/118 |

FOREIGN PATENT DOCUMENTS

| | | | |
|---|---|---|---|
| 712184 | 7/1931 | France | 46/118 |
| 760494 | 12/1933 | France | 46/123 |

*Primary Examiner*—F. Barry Shay
*Attorney, Agent, or Firm*—Richard M. Rabkin

[57] ABSTRACT

The toy doll includes a flexible body and a head portion which are shaped to respectively include the upper and lower portions of the doll's mouth. Means are provided in the head for pivoting the head portion with respect to the body when the body is squeezed, thereby to open and close the doll's mouth. A reed sound mechanism is provided in the body for making a child-like sound when the body is squeezed.

16 Claims, 6 Drawing Figures

BIG MOUTH DOLL

The present invention relates to toy dolls and more particularly to a toy doll adapted to move its mouth while producing sounds.

Toy dolls adapted to produce sounds when squeezed are well known and have been made in a variety of different forms. Primarily, these dolls have flexible bodies and reed units mounted therein so that when squeezed, air is expelled from the interior of the body through a reed device which is vibrated to produce a whistle-type sound. Such dolls are shown, for example, in U.S. Pat. Nos. 3,093,928 and 3,119,198. The latter is of interest in that it additionally discloses an arrangement whereby the lower lip of a flexible portion of the doll's head is moved while the sound is made, in order to simulate a mouth movement.

By the device of the present invention a toy doll is provided which has a flexible body which, when squeezed, moves the upper portion of the doll's head, while producing a sound through a reed-like device. Movement of the doll's head in this manner produces an unusual and pleasing result.

In accordance with an aspect of the present invention the toy doll includes a flexible body portion and a head portion. The body portion has an upper neck portion which is shaped to include the lower portion of the doll's mouth, while the head portion is shaped to define a wide upper portion of the doll's mouth. A head block is mounted in the head and a neck or body block is mounted in the neck portion of the body, and these blocks are pivotally connected to each other. A plunger arrangement is provided in the body block which, upon squeezing of the flexible body, is driven upwardly to lift the head block away from the body block. Spring means is provided in the head block to normally bias the head into its closed position against the body block, so that the mouth of the doll automatically closes when the squeezing pressure on the flexible body is released.

During squeezing of the doll's body, air is forced through the reed device to produce the desired sound.

The above, and other objects, features and advantages of this invention will be apparent in the following detailed description of an illustrative embodiment thereof, which is to be read in connection with the accompanying drawings, wherein.

Figure 1:
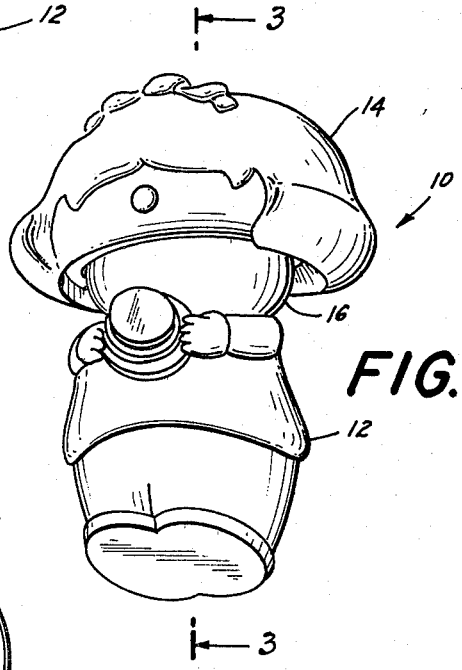
FIG. 1 is a perspective view of a toy doll constructed in accordance with the present invention with its head and mouth in the normal closed position.

Referring now to the drawings in detail, and initially to FIG. 1 thereof, a toy doll 10 includes a flexible body portion 12 and a head 14. These body portions may each be formed of flexible plastic material by any conventional molding process. Means are provided within the doll for selectively moving head 14 from the closed position shown in FIG. 1 to the open position shown in FIG. 2 upon squeezing of the flexible body of the doll.

Figure 2:
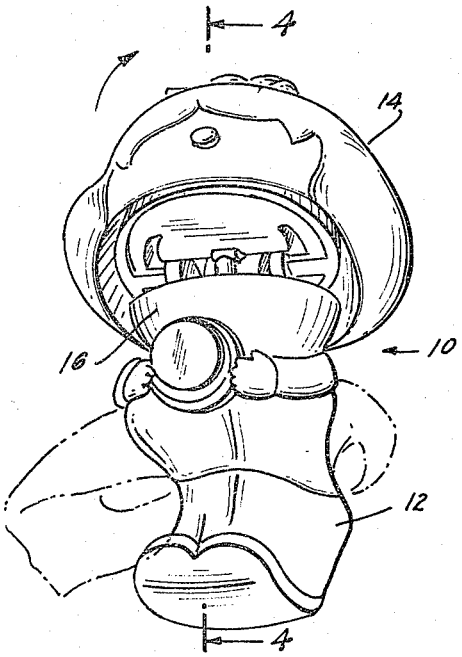
FIG. 2 is a perspective view similar to FIG. 1, but showing the body of the doll squeezed with its mouth in the open position.

As seen in FIGS. 1 and 2 the doll's body is formed so that the head portion 14 of the doll defines the principal facial features up to and including the upper portion or upper lip of the doll's mouth. The lower body portion of the doll is formed with a neck portion 16 which is shaped to include the lower mouth portion or lower lip of the doll so that the separation between body portion and the head portion defines the doll's mouth, with the result that when the doll's head is moved from its closed to its open position, the doll's mouth is also opened. The mechanism contained within the doll which produces this movement of the doll's head includes a device for producing a sound when the body is squeezed.

Figure 3:
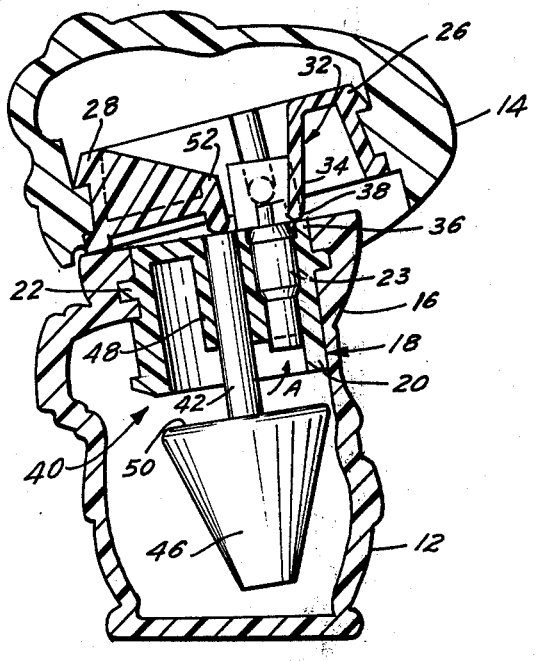
FIG. 3 is a side sectional view taken along line 3—3 of Figure 1.
Figure 4:
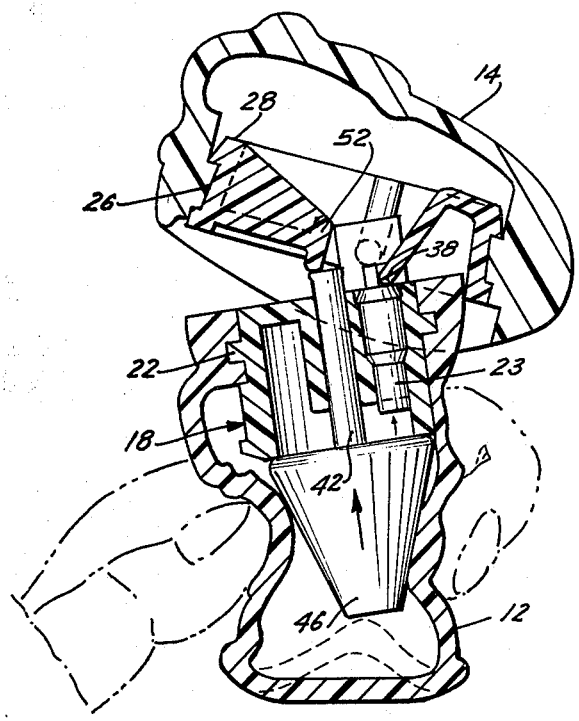
FIG. 4 is a side sectional view taken along line 4—4 of FIG. 2.

Referring now to FIGS. 3 and 4 of the drawing, it is seen that the doll's body 12 includes a neck or body block 18 rigidly mounted in the neck portion 16 thereof. This body block consists of a generally cylindrical member 20 having a peripheral flange 22 that is rigidly mounted by a friction, relatively air tight fit within a complimentary annular groove formed in the interior of the body's neck 16. A conventional reed device 23 is mounted in cylinder 20 in any convenient manner, so that when air is expelled from the doll's body 12 in the direction of the arrow A in FIG. 3, the reed of device 23 is vibrated to produce the desired sound.

Figure 6:
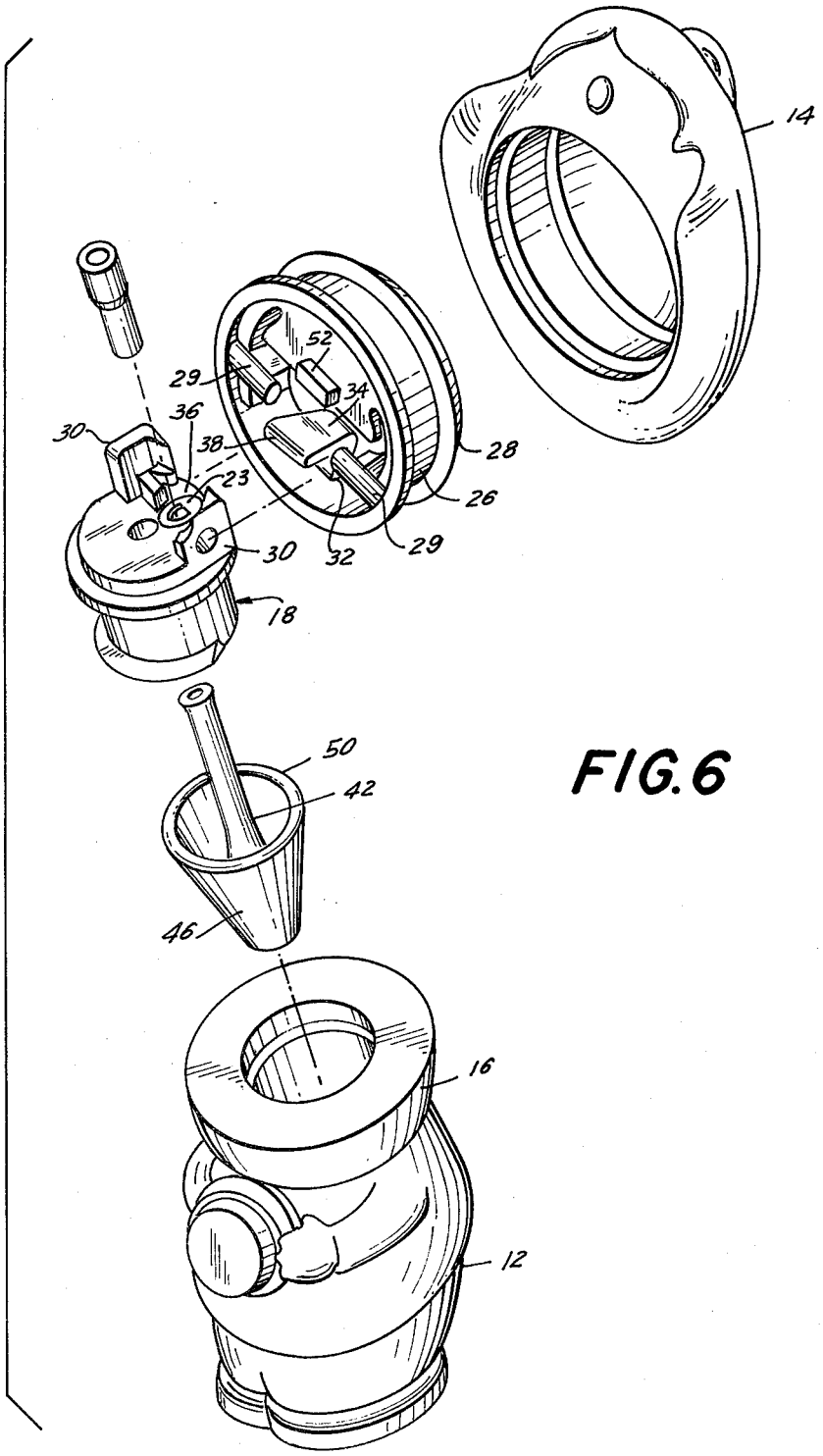
FIG. 6 is an exploded perspective view of the components forming the doll of the present invention.

A head block 26 is rigidly mounted in the head portion 14 of the doll. This head block also is a generally cylindrical member having a oeripheral flange 28 embedded within an annular groove in the interior of head 14. As seen in FIG. 6, head block 26 includes a pair of pivot pins 29 integrally formed therewith which are received in pivot bosses 30 formed on body block 18, whereby the head and body blocks are pivotally connected to one another. By this arrangement head portion 14 can pivot with respect to body 12.

Head portion 14 is normally maintained in its closed position by a spring member 32 which is integrally formed with head block 26. This spring member is a generally L-shaped integral leaf spring having a depending leg 34 which bears against the upper surface 36 of neck block 18. The end 38 of spring 32 is tapered, as seen in FIG. 3, and is located rearwardly of pivot pins 29 so that a biasing force is produced on the head block tending to pivot the head block in the counter-clockwise direction of FIG. 3 to maintain the head block in its relatively closed position, whereby the mouth of the doll remains closed.

In order to selectively open the doll's mouth upon squeezing of the doll a plunger arrangement 40 is provided which includes a stem 42, an upper end portion 44 and a lower end portion 46. Stem portion 42 is slidably mounted in a collar 48 formed in cylinder 20. The limits of sliding movement of the stem are defined at one end by the upper end 44 of the stem, which is swaged in any convenient manner to prevent retraction of the stem through the sleeve 48. Upward movement of the stem is limited by engagement of the base portion 50 of the lower end 46 of the plunger against the bottom of cylinder 20. The lower end portion of plunger 40, as seen in FIGS. 3 and 4, is generally conically shaped, with the cone being inverted relative to the upright position of the doll. By effecting longitidinal sliding movement of plunger 42, from its position shown in FIG. 3 to its position shown in FIG. 4, the doll's head can be opened against the bias of the spring 32.

Figure 5:
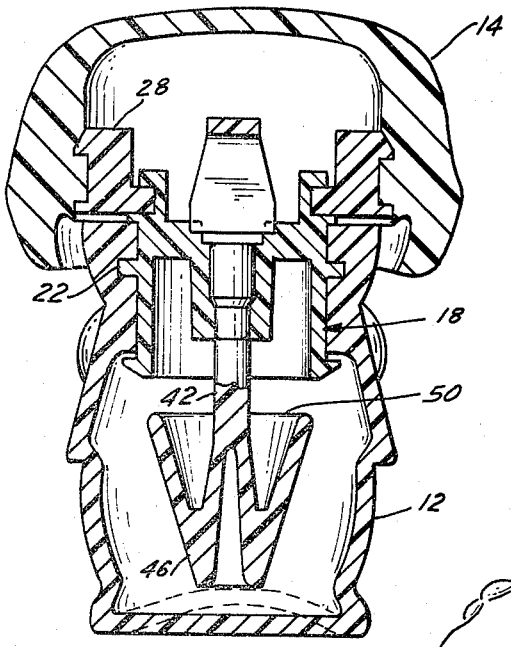
FIG. 5 is a front sectional view taken along line 5—5 of FIG. 1.

Due to the conical shape of the lower end 46 of plunger 40, when the doll's body is squeezed, engagement of the side walls of the doll against the surface of its cone-shaped lower portion 46 drives plunger 40 upwardly. The upper end 44 thereof then engages an abutment 52 formed on head block 26 and causes the head block to pivot in a clockwise direction against the bias of spring 32, opening the doll's mouth. Similar upward movement can be achieved by pressing the base 54 of the doll's body upwardly, as shown by dotted lines in FIGS. 4 and 5.

When the doll's body is squeezed, the volume of the body is reduced, and air contained therein is forced through reed 23 producing the desired sound at the same time that the doll's mouth is opened. When pressure against the doll's body is released, air rushes through the reed in the reverse direction filling the body, while the head returns to its closed position as a result of the bias force of spring 32. As seen in FIGS. 3 and 4, plunger 40 and spring 32 are located on opposite sides of the pivot axis between the head block and the body block, so that the spring and plunger act in opposite directions to selectively open and close the doll's head.

Accordingly it is seen that a relatively simply constructed toy doll is provided which produces a novel wide open mouth effect in the doll when the doll's body is squeezed, while at the same time producing the desired sound in the doll. The device is relatively simply constructed and will be durable in use, while economical to manufacture.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A toy doll comprising a flexible body, a head portion and means in said body and head portion for pivoting said head portion with respect to said body when the body is squeezed; said body including an upper portion shaped to define the lower portion of the doll's mouth and said head portion defining the upper portion of the doll's mouth whereby said pivotal movement of the head portion simulates opening of the doll's mouth; said means including a body block fixed in said upper end of said flexible body, a head block fixed in said head portion and means directly pivotally connecting said head and body blocks.

2. A toy doll as defined in claim 1 including reed means for producing a sound upon squeezing of said body.

3. A toy doll as defined in claim 1 wherein said pivot means is located rearwardly of the vertical centerline of the doll.

4. A toy doll as defined in claim 1 including spring means for normally biasing said head block towards said body block into a relative closed position.

5. A toy doll as defined in claim 4 wherein said spring means comprises an integral resilient spring formed on said head block and engaged with said body block.

6. A toy doll as defined in claim 4 wherein said pivoting means includes plunger means slidably mounted in said body block for relative vertical sliding movement and including a first end portion adapted to engage said head block to pivot the head block vertically against the bias of spring means.

7. A toy doll as defined in claim 6 wherein said plunger includes a second lower end portion located in said flexible body portion and contoured to drive the plunger upwardly when the body portion is squeezed.

8. A toy doll as defined in claim 7 wherein said contoured portion of the plunger is shaped as a cone.

9. A toy doll comprising a flexible body and a head portion, said body having a neck portion and a body block fixedly mounted in said neck portion; said head portion being shaped to define at least the upper portion of a mouth and having a head block fixedly mounted therein; means directly pivotally connecting said head and body blocks, spring means in said doll for normally biasing said head block toward said body block, and means mounted in said body block for pivoting said head block away from the body block against the bias of said spring means, thereby pivoting said head portion away from said neck portion, upon squeezing of said flexible body portion.

10. A toy doll as defined in claim 9 including means in said body for producing a sound upon squeezing of said body.

11. A toy doll as defined in claim 10 wherein said sound producing means comprises a sound reed mounted in said body block.

12. A toy doll as defined in any one of claims 9 and 10 wherein said neck portion of the body includes a portion shaped as the lower mouth portion of the doll to cooperate with the upper portion of the mouth on the head portion whereby pivotal movement of the head portion simulates opening and closing of the doll's mouth.

13. A toy doll as defined in claim 12 wherein said means for pivoting said head block comprises a plunger slidably mounted in the body block for longitudinal sliding movement and including an upper portion positioned to engage the head block and a lower portion, located within said flexible body, being contoured to drive the plunger towards the head block when the body is squeezed.

14. A toy doll as defined in claim 13 wherein said lower portion of the plunger is shaped as an inverted cone.

15. A toy doll as defined in claim 14 wherein the pivotal connection between the body and head blocks is located rearwardly.

16. A toy doll as defined in claim 15 wherein said spring means is formed integrally with said head block.

* * * * *